US006318992B1

(12) United States Patent
Sung

(10) Patent No.: US 6,318,992 B1
(45) Date of Patent: Nov. 20, 2001

(54) SLIDE-SAFETY BUTTON CHILD-RESISTANT UTILITY LIGHTER

(76) Inventor: Kil Yong Sung, 1434 Atherton Cir., Fullerton, CA (US) 92833

( * ) Notice: Subject to any disclaimer, the term of this patent is extended or adjusted under 35 U.S.C. 154(b) by 0 days.

(21) Appl. No.: 09/531,083

(22) Filed: Mar. 18, 2000

(51) Int. Cl.[7] ..... F23D 11/36
(52) U.S. Cl. ..... 431/153; 431/255
(58) Field of Search ..... 431/153, 255, 431/344, 345, 277; 222/153.14

(56) References Cited

U.S. PATENT DOCUMENTS

| | | | | |
|---|---|---|---|---|
| 4,502,465 | | 3/1985 | Yoshinaga . | |
| 4,859,172 | * | 8/1989 | Nitta | 431/153 |
| 5,412,179 | | 5/1995 | Chen . | |
| 5,451,159 | | 9/1995 | Kim . | |
| 5,492,468 | | 2/1996 | Cirami . | |
| 5,496,169 | | 3/1996 | Chen . | |
| 5,655,901 | * | 8/1997 | Makoto | 431/153 |
| 5,697,775 | * | 12/1997 | Saito et al. | 431/153 |
| 5,967,768 | | 10/1999 | Saito . | |
| 5,980,242 | * | 11/1999 | Man | 431/153 |
| 6,010,328 | * | 1/2000 | Sung | 431/153 |
| 6,012,916 | * | 1/2000 | Liang | 431/153 |
| 6,022,212 | | 2/2000 | Saito . | |
| 6,042,367 | | 3/2000 | Saito . | |
| 6,050,810 | | 4/2000 | Huang . | |
| 6,059,563 | * | 5/2000 | Hsu | 431/153 |
| 6,065,958 | | 5/2000 | Adams . | |
| 6,168,423 | | 1/2001 | Man . | |
| 6,217,313 | | 4/2001 | Luo . | |

FOREIGN PATENT DOCUMENTS

| | | | |
|---|---|---|---|
| WO 99/47855 | | 9/1999 | (WO) . |
| WO-99/60309-A2 | * | 11/1999 | (WO) . |

* cited by examiner

*Primary Examiner*—Ira S. Lazarus
*Assistant Examiner*—Josiah C. Cocks
(74) *Attorney, Agent, or Firm*—Trojan Law Offices

(57) ABSTRACT

A safety mechanism of a utility lighter that includes a locking mechanism and a safety button. The locking mechanism includes a locking spring, a locking lever and a stopper tab. In the locked position the locking mechanism prevents the trigger from being depressed. The locking lever engages the stopper tab when in the locked position. The safety button, when activated, depresses the locking lever which unlocks the trigger. Activating the safety button also opens the valve and fuel is released. In order to maintain a flame the safety button must be continuously activated.

1 Claim, 5 Drawing Sheets

SLIDE-SAFETY BUTTON CHILD-RESISTANT UTILITY LIGHTER

FIELD OF INVENTION

This invention relates to a utility lighter which contains a safety feature incorporating a safety button, wherein the safety button slides forward to operate the fuel-release valve and unlock the trigger.

BACKGROUND ART

Utility lighters are very useful and have become quite prevalent in modern times. Utility lighters of the type described herein generally contain a handle and an elongated lighting rod. The shape and operation of utility lighters allow for several advantages over normal means of producing a flame. Most significantly, due to the elongated nature of the lighting rod, utility lighters enable the operator to stand a safe distance away from the object to be ignited before actuating the lighter, thus avoiding a large number of potential accidents. In addition, utility lighters allow a flame to be produced in hard-to-reach or narrow places, where the human hand holding a match would not normally fit. Still, in the hands of children, or others who do not know how to safely and properly operate the lighter, such lighters are as dangerous as any other spark and/or flame-producing device. Therefore, a need has been realized to equip utility lighters with safety features that minimize accidental or improper use by inexperienced persons, especially young children.

Many inventions have been created to address this safety-related concern. Generally, these inventions have sought to introduce safety mechanisms that disable automatic operation of either the spark-generation or the fuel-release function of the lighter or both. For example, some utility lighters provide for a blocking mechanism, where the actuating trigger is blocked from moving the required distance for a spark to be generated. In these lighters, the locking mechanism is normally de-activated by sliding an "on/off" switch to the "on" position, or by other means, so as to remove the impediment from the actuating trigger's operating path.

Although utility lighters of the type described above provide some level of safety, there is much room for improvement. Specifically, in these lighters, once the locking means (e.g., the on/off switch) is disabled, the lighter remains in the unlocked state until the locking mechanism is activated again. Therefore, if the operator disables the locking mechanism in order to use the lighter, and then forgets to re-lock the lighter, the safety feature of the lighter is rendered useless, until the locking mechanism is again activated.

Other inventions have attempted to address the safety-related issues by impeding not the operation of the trigger, but that of the fuel-release mechanism. Of course, a utility lighter containing such a mechanism would inhibit flame generation in the locked position as no fuel would be released until the locking mechanism has been deactivated. However, in these types of lighters, nothing prevents a spark from being generated. As such, the safety goals are only partially met in these types of lighters since young children handling the lighter could still create fires by operating the lighter in close proximity to a source of fuel or near carpets, paper, or other flammable material.

In order to address the above problems, some inventions have introduced locking mechanisms that are activated automatically after each use of the lighter. As such, in these lighters, two states of operation exist: the locked state and the operable state. In the locked state, neither a spark nor a flame can be generated. In contrast, in the operable state, the lighter is no longer locked, so that a flame can be generated. Although, in general, this improvement has alleviated some of the concerns mentioned above, there is still room for further improvement.

Specifically, in most dual-state, automatic-locking lighters, once the lighter is unlocked and the trigger activated, the flame that is generated will subsist for as long as the trigger is held in the depressed position. In other words, once the locking mechanism is disabled, flame generation is a simple task involving depression of the trigger. This is of some concern since even young children might be able to achieve this task.

Therefore, there is a need for a device that not only achieves the stated safety goals in generating a flame, but also makes it difficult for inexperienced users or young children or both to sustain the flame. The invention described herein offers such a combination. The invention requires that a safety button, protruding generally from the top portion of the lighter housing shell, be actuated prior to depression of the trigger to produce a flame. In addition, the invention requires that the safety button, and not the trigger, be held in its activated state to sustain the flame; releasing the safety button after generating a flame extinguishes the flame.

The unique structure of the safety button contained in the present invention provides for an optimum amount of safety as it makes it very difficult, if not impossible, for young children to operate the device. Young children are capable of carrying out only simple mental tasks. As such, a young child wishing to operate the present invention would attempt to do so in the usual way, i.e., by pressing the trigger. However, because of the automatic locking mechanism, the trigger will not move. This feature alone acts as a deterrent because most young children will simply abandon the device after several unsuccessful attempts.

If the child does recognize that the slide-safety button plays a role in activating the lighter, then the child operator must also recognize that the safety button must be operated prior to the trigger to generate a flame. This is generally too convoluted a concept for young children to grasp or appreciate.

Nevertheless, even if a young child were to learn the proper operation of the device, the child would probably still be unable to actually operate the device. Given the relative location of the trigger and the safety button, operation of the present invention requires that the user be able to grasp the handle of the lighter in his or her hand, operate the slide-safety button with the thumb, and operate the trigger with the index finger. This, in turn, requires not only a significant amount of manual dexterity, but also hands that are sufficiently large, namely, adult hands. Moreover, successful operation of the device requires strength that is rarely found in young children's hands In addition, even if a child were to posses the mental capacity for understanding and learning the required operation process, a large enough hand, and the required manual dexterity and strength, to generate a flame, he would have to recognize a second concept: that the flame will not be sustained unless the safety button is held in its activated state. Again, this is a difficult mental concept for a child to recognize and learn. Moreover, even if learned, the concept would be difficult for a child to operationalize given the above discussion regarding the mental and physical limitations of young children. On the other hand, an adult user would have no difficulty operating the invention as the device requires no more than the operation of two strategically positioned buttons.

In addition to all of the safety advantages described above, the invention described herein offers a significant reduction in cost of manufacturing and a significant increase in ease of manufacturing.

SUMMARY OF THE INVENTION

The primary object of this invention is to provide a safety mechanism for utility lighters so that children or inexperienced users will be less likely to activate the lighter. Such a safety feature is especially important because young children often play with lighters as toys and because lighters have mechanically moveable parts that make them attractive to children as toys.

Another object of the present invention is to prevent the generation of not only a flame, but even a spark. As noted previously, in a lighter where only the fuel-release mechanism is inhibited in the locked state, young children playing with the lighter can still use the lighter to create sparks. Depending on the child's surroundings, this can lead to the start of accidental fires if the child is operating the lighter near paper products or any other source of inflammable material.

A further object of the invention described herein is to provide an improved device for maximizing safety in utility lighters without compromising ease of use. To this end, the addition of a safety button creates a simple additional step which, for the intended user, leaves the operation of the utility lighter as simple as it has always been to operate a regular utility lighter with no safety feature, yet, creates an additional mental step which acts as a deterrent for unintended users.

Another object of this invention is to reduce the risk of unintended fires, especially by young children, by making it impossible for the flame to continue to burn unless two (2) separate functions are performed and operation of a safety button is continued without interruption.

A final object of the present invention is to meet all of its safety goals while, at the same time, maximizing ease of manufacturing and minimizing costs associated with manufacturing of parts.

These and other advantages of the present invention will become more apparent through the following description of the drawings and detailed description of the preferred embodiment.

DETAILED DESCRIPTION OF THE PREFERRED EMBODIMENT

Figure 1:
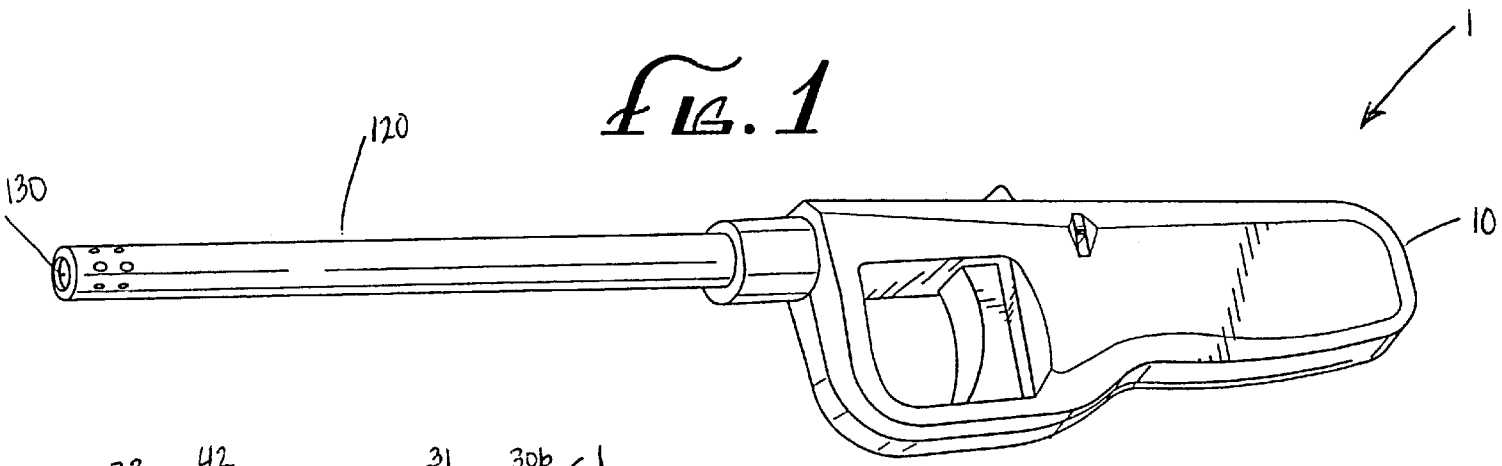
FIG. 1 is a perspective view of the child-resistant utility lighter.
Figure 2:
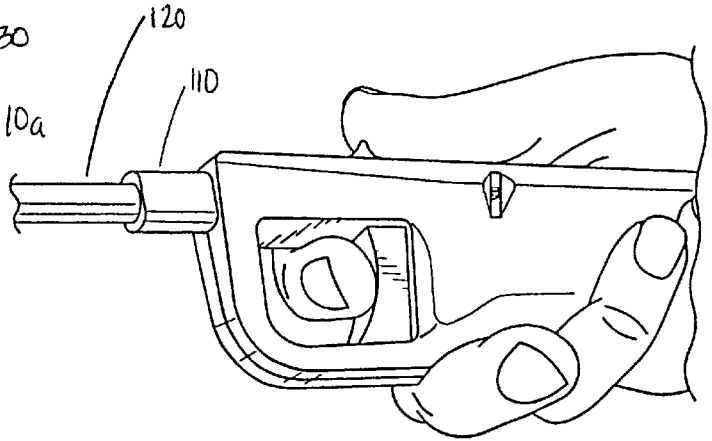
FIG. 2 is an environmental view of the child-resistant utility lighter in use.

A general description of the piezoelectric utility lighter (1) (FIG. 1) will be provided before presenting a detailed description of the improvement in the safety feature that constitutes the invention.

Figure 3:
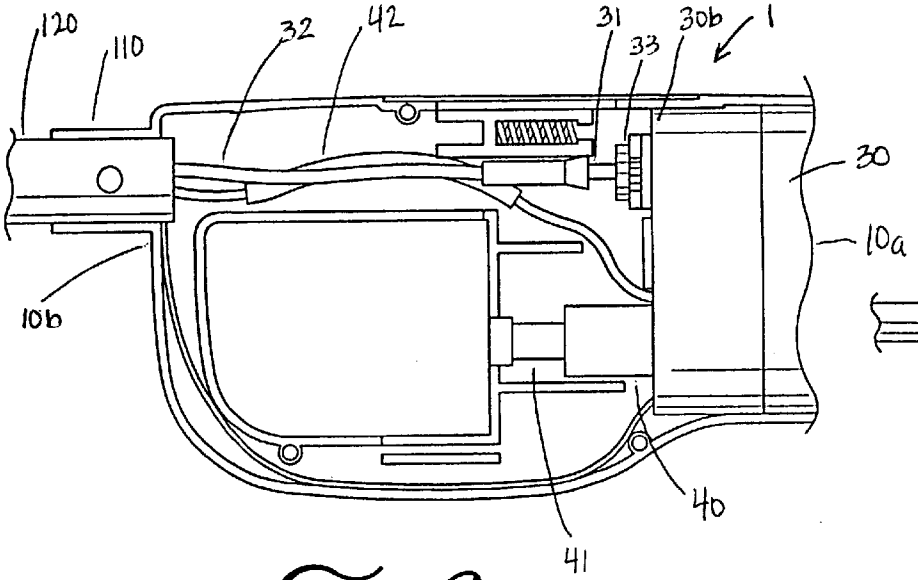
FIG. 3 is a sectional view of the first embodiment of the lighter without the trigger, the safety button, the locking spring, or the stopper tab.

Generally, the elements of the utility lighter (1) include a lighter housing (10), a lighting rod attached to the forward end of the lighter housing via a support ring (110) which slides over the overlapping portions of the lighter housing and lighting rod (120), a fuel tank (30) (FIG. 3), a piezoelectric unit (40), and a trigger (100).

The lighter housing (10) is comprised of two shells, cut along the longitudinal axis of the lighter (1). The lighter housing (10) has a back end **(10*a*) (FIG. 1) and a forward end (10*b*), where the forward end is equipped with a support ring (110) to engage a lighting rod (120). The lighting rod, which typically has a cylindrical cross section, has a free end which constitutes the tip of the lighter (1) and an engagement end which connects to the forward end of the lighter housing. Where the forward end of the lighter housing and the engagement end of the lighting rod overlap, the support ring (110)** slides over and maintains the lighter housing-lighting rod combination.

The lighter (1) is equipped with a fuel tank (30) near the back end **(10*a*) of the lighter housing (10). The fuel tank (30) has a bottom portion (30*a*) facing the back end (10*a*) of the lighter housing, and a top portion (30*b*) pointing towards the forward end of the lighter housing. A valve (31) for releasing fuel is attached to the top portion (30*b*) of the fuel tank. The valve is spring loaded so that it is normally urged to the closed position. The valve is also provided with a gas tube (32) which extends through the lighting rod and to a discharge nozzle (130) at the free end of the lighting rod. The valve is opened via the translation of the safety button (70). Finally, a flame-adjusting knob (33) is provided on the valve (31)** which can be turned to adjust the amount of fuel released and, thus, the height of the resultant flame.

Figure 4:
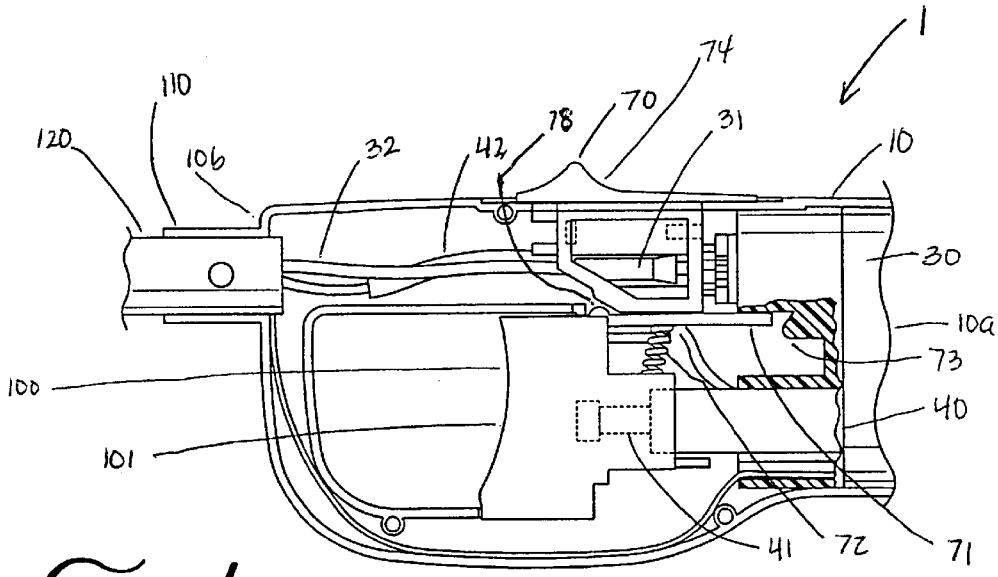
FIG. 4 is a sectional view of the first embodiment of the lighter.

The next element of the lighter (1) is a piezoelectric unit (40) (FIG. 4). This unit is fitted within the top portion **(30*b*) of the fuel tank and protrudes from said top portion. The upper section of the piezoelectric unit (40) constitutes the sliding section (41). The sliding section (41) contacts the trigger (100). Actuation of the piezoelectric unit (40) creates an electric discharge that is carried to the free end of the lighting rod via a wire (42)**.

The present invention includes a trigger, a locking mechanism, and a safety button.

The trigger (100) is slidably mounted between the two shells of the lighter housing (10). As in conventional utility lighters, the trigger (100) is allowed to slide back and forth along the longitudinal axis of the lighter (1). The trigger (100) has an operation section (101) that protrudes from the lighter housing (10) so as to be operated by a finger of the user.

Generally, the operation section (101) has a surface that is slightly curved so as to appear concave. However, the invention described herein is amenable to different degrees of curvature for the operation section (101) of the trigger (100). The trigger (100) contacts the sliding section (41) of the piezoelectric unit (40). Full depression of the trigger results in actuation of the piezoelectric unit.

The locking mechanism includes locking lever (71), a locking spring (72), and a stopper tab (73). The locking mechanism prevents the trigger from being depressed until the safety button (70) has been translated into the active position. The safety button, when in the active position, opens the valve to release fuel.

Figure 6:
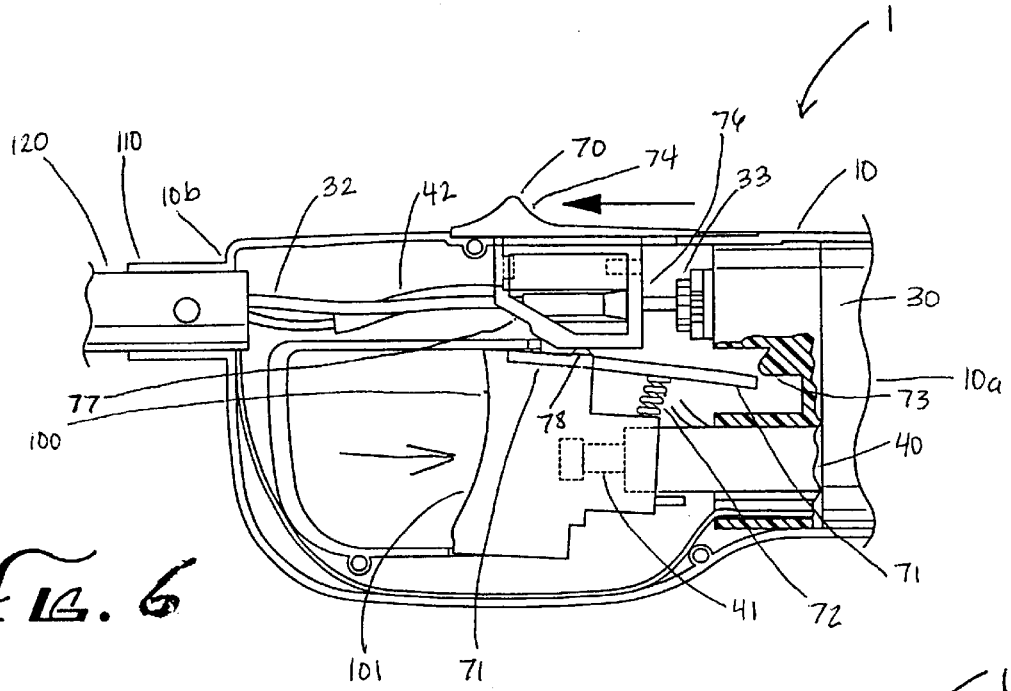
FIG. 6 is a sectional view of the first embodiment with the safety button being translated in the direction of the arrow and the trigger being depressed in the direction of the arrow.
Figure 7:
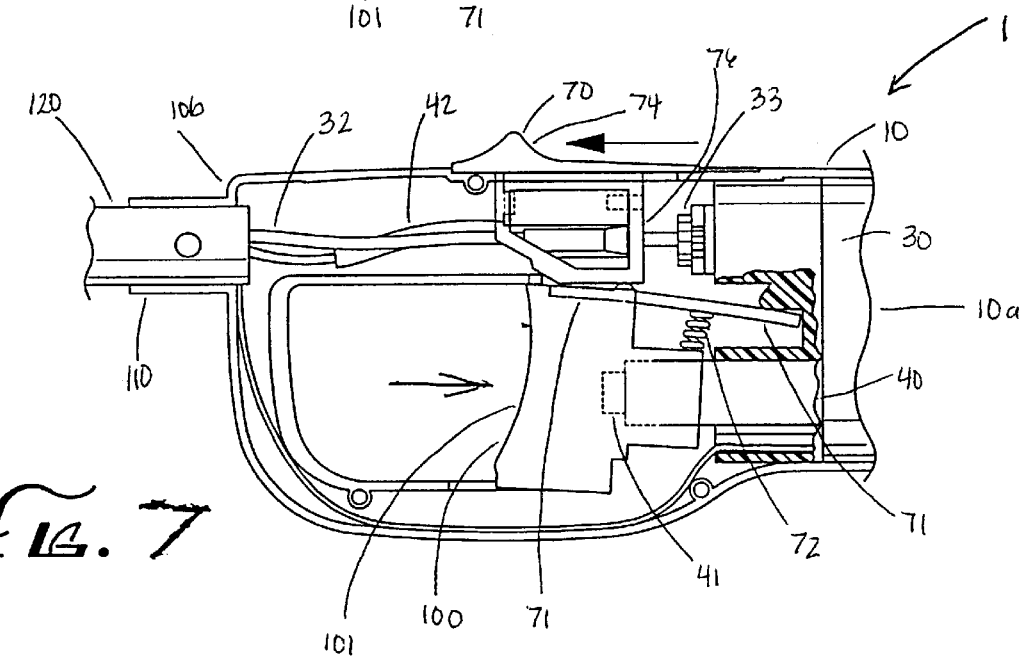
FIG. 7 is a like view with the trigger fully depressed.
Figure 8:
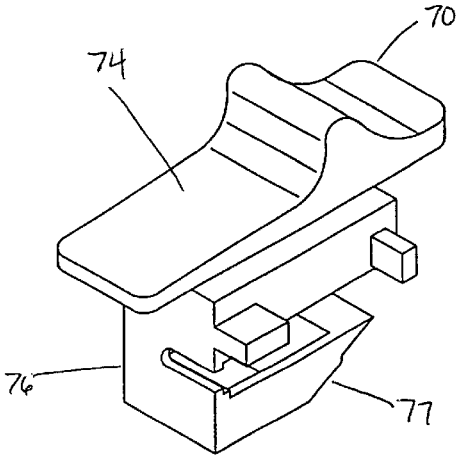
FIG. 8 is a perspective view of the right side of the safety button.
Figure 9:
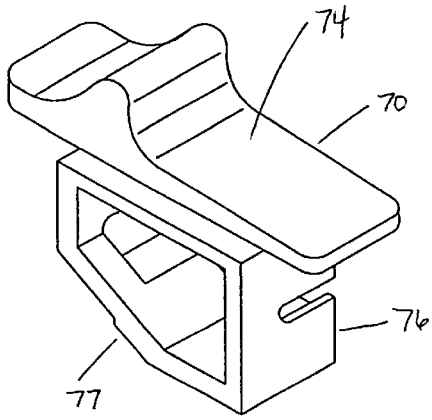
FIG. 9 is a perspective view of the left side of the safety button.

The safety button is slidably mounted in the lighter housing The safety button includes a contact surface (74) (FIGS. 8 and 9), a return spring (75), a fuel-releasing segment (76), and a unlocking segment (77). The contact surface protrudes beyond the lighter housing for receiving the user's finger. The safety button is translated from its initial position to its active position when the user pushes the safety button forward in the direction of the arrow A (FIGS. 6 and 7). The return spring constantly urges the safety button into its initial position.

The fuel-releasing segment (76) of the safety button is located between the valve (31) and the flame-adjusting knob (33). The unlocking segment (77) of the safety button is located above the trigger. When the safety button is translated by being pushed forward, the fuel-releasing segment opens the valve, and fuel is released.

Figure 10:
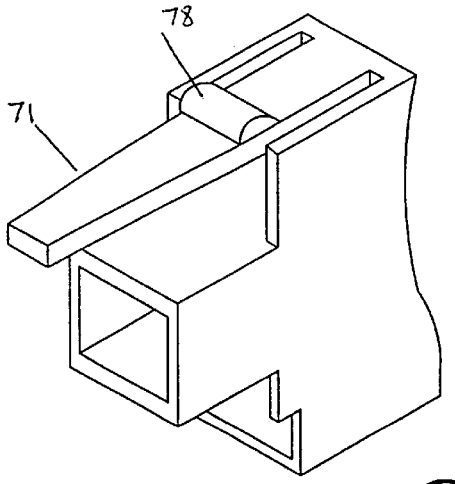
FIG. 10 is a perspective view of the trigger of the first embodiment.

The first preferred embodiment of the invention includes a trigger (100) (FIG. 4), a stopper tab (73), a safety button (70), and a locking spring (72). The trigger (FIG. 10) includes an operation section (101), a locking lever (71), a projection (78), and a locking spring (72). The stopper tab is formed in the top portion of the fuel tank. The locking spring is mounted to the lighter housing and is constantly urging the trigger into the locked position.

Figure 5:
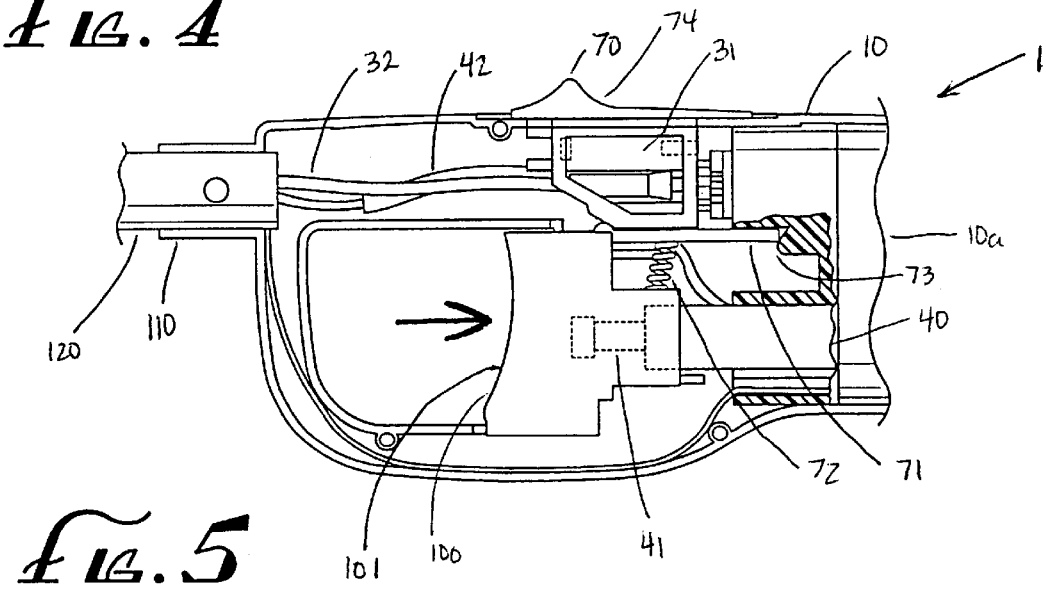
FIG. 5 is a sectional view of the first embodiment with the trigger being depressed in the direction of the arrow while the trigger is in the locked position.

Depression of the trigger alone (FIG. 5) without also activating the safety button, results in the locking lever engaging the stopper tab. Thus preventing actuation of the piezoelectric unit.

Activation of the safety button causes the unlocking segment (77) (FIG. 6) to interact with the projection (78). This interaction between the unlocking segment and the projection forces the locking lever downward thus disengaging it from the stopper tab. The projection must be sufficiently large to move the locking lever a sufficient distance such that it cannot engage the stopper tab. As a result, the trigger can be fully depressed thus actuating the piezoelectric unit.

Once a flame has been generated, it can be sustained only if fuel continues to be supplied. Simply holding the trigger (100) in the depressed state will not sustain the flame. Fuel continues to be supplied only as long as the safety button (70) is held in the active position.

When the safety button is released the return spring urges the safety button into its initial position. As a result, the locking lever (71) of the trigger returns to the locked position and the valve (31) returns to the closed position. Once in the locked position, the locking lever (71) of the trigger re-engages the stopper tab (73). Therefore, the lighter is thereby automatically relocked.

Figure 11:
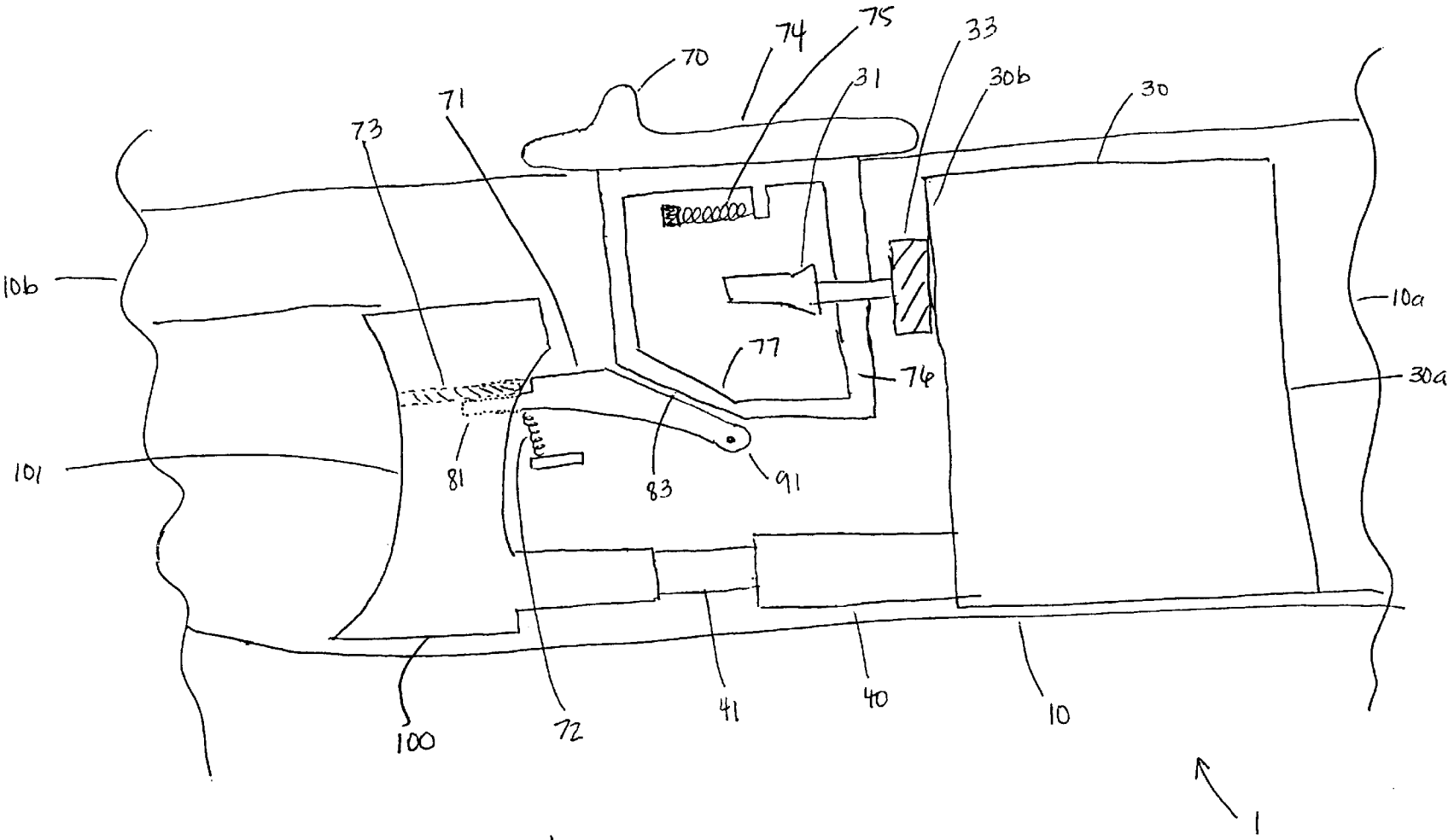
FIG. 11 is a sectional view of the second embodiment.

The second preferred embodiment of the invention includes a trigger (100) (FIG. 11), a safety button (70), a locking lever (71), and a locking spring (72).

The locking lever has a first end (81) and a second end (91). The second end of the locking lever is pivotally mounted to the lighter housing. The trigger (100) includes a stopper tab (73). The stopper tab (73) engages the first end (81) of the locking lever (71). The interaction between the stopper tab and the first end of the locking lever, and as a result, the trigger cannot be squeezed to activate the lighter. The locking spring (72) urges the locking lever into the locked position.

The unlocking segment (77) of the safety button (70) includes a ramped portion (83). When the safety button is activated, the ramped portion contacts the locking lever (71) and depresses the locking lever. When the locking lever is depressed the locking lever is disengaged from the stopper tab (73). Thus activating the safety button unlocks the trigger, and the trigger can then be depressed and the piezoelectric unit actuated.

Once a flame has been generated, it can be sustained only if fuel continues to be supplied. Simply holding the trigger (100) in the depressed state will not sustain the flame. Fuel continues to be supplied only as long as the safety button (70) is held in the active position.

When the safety button is released the return spring (75) urges the safety button into the initial position. Once the safety button is in its initial position, the locking lever (71) returns to the locked position under the force of the locking spring (72) and the valve (31) returns to the closed position. When the locking lever returns to the locked position, the locking lever (71) again engages the stopper tab (73). The lighter is thereby automatically relocked.

I claim:

1. A utility lighter comprising: a lighter housing, a lighting rod projecting from the lighter housing, a fuel tank, located within the lighter housing, a valve, being spring loaded so as to be urged into the closed position, for releasing fuel, a gas tube connected to the valve and extending through the lighting rod, and a conventional piezoelectric unit for generating a spark;

a trigger, slidably mounted in the lighter housing, having an exterior surface capable of being engaged by a user for slidably activating the piezoelectric unit, said trigger also having an interior portion positioned substantially within said lighter;

a locking mechanism comprising a locking lever, a locking spring, and a stopper tab;

said locking lever extending from said interior portion of said trigger and having a top surface with a first elevation and a second elevation;

said locking spring capable of urging the locking lever into a position so that the locking lever is biased against the stopper tab to prevent said trigger from sliding a sufficient distance to engage said piezoelectric unit;

a safety button, which is slidably mounted on said housing and capable of moving in a substantially parallel but opposite direction to said trigger;

said safety button having a contact surface, a fuel release segment and a unlocking segment;

said contact surface capable of manipulation by a user so that said fuel release segment opens said valve to release fuel while the unlocking segment substantially and simultaneously moves from a position in which it is in contact with said first elevation of said locking lever to a position in which the fuel release segment is in contact with the second elevation of said locking lever whereby said locking lever is caused to move out of interference with the stopper tab permitting said activation of said piezoelectric unit by said trigger to ignite the fuel being released from said valve.

* * * * *